United States Patent [19]

Bellerose

[11] Patent Number: 4,546,684

[45] Date of Patent: Oct. 15, 1985

[54] POTATO SLICER

[75] Inventor: Richard J. Bellerose, Concord, N.H.

[73] Assignee: J. C. Pitman Company, Inc., Concord, N.H.

[21] Appl. No.: 521,591

[22] Filed: Aug. 9, 1983

[51] Int. Cl.[4] ..... B26D 7/06

[52] U.S. Cl. ..... 83/355; 83/592; 241/92

[58] Field of Search ..... 83/355, 356.3, 592; 241/37.5, 92, 273.2, 281.1, 281.2

[56] References Cited

U.S. PATENT DOCUMENTS

| | | | |
|---|---|---|---|
| 183,132 | 10/1876 | Clinton | 241/282.1 X |
| 1,039,441 | 9/1912 | Ray | 241/92 |
| 2,796,103 | 6/1957 | Feinstein | 83/356.3 |
| 4,177,703 | 12/1979 | Cavier | 83/356.3 |
| 4,216,917 | 8/1980 | Clare et al. | 241/92 X |

*Primary Examiner*—James M. Meister

*Attorney, Agent, or Firm*—LeBlanc, Nolan, Shur & Nies

[57] ABSTRACT

A motor driven slicing machine for potatoes and the like is disclosed. The machine includes a circular fly wheel with a blade thereon which rotates across an exit port. Potatoes enter a feed tube at an entrance port and wedge against an outwardly tapered wall at the exit port so as the potato is sliced it is urged into the exit port by the slicing action against the tapered wall. Slices fall through an opening in the fly wheel to be collected or cooked.

3 Claims, 5 Drawing Figures

POTATO SLICER

This invention relates to a machine for continuously slicing potatoes or similar dimensioned objects preferably to be used in conjunction with a deep fat fryer for production of potato chips.

In a co-pending patent application entitled "Continuous Fryer for Potato Chips", Ser. No. 511,985, filed July 8, 1983, now U.S. Pat. No. 4,488,478, and assigned to the assignee of this invention, there is disclosed a continuous frying machine adapted to commercial usage by small potato chip manufacturers, shops, restaurants, and the like, wherein potato chips may be continuously cooked. That cooker utilizes hot oil and a continuous conveying system to convey raw potato slices through the hot oil to cook the slices. On a continuous basis then when raw potato slices are fed into the machine and cooked potato chips or the like exit the machine for consumption or packaging. In conjunction with this machine then it is necessary to have a controlled volume slicing apparatus to produce the raw potato slices to be cooked to chips in a volume compatible with the capacity of the machine.

Because the frying apparatus is intended for commercial or industrial use, a hand slicer would not produce raw potato slices in sufficient volume. On the other hand, because the machine is intended for controlled volume production a large volume automatic slicing apparatus is unnecessary and would be too expensive. Accordingly, there is a need for a semi-automatic slicing apparatus which will rapidly and efficiently slice raw potatoes, essentially one-at-a-time for use with a continuous fryer adapted to the needs of small independent potato chip producers including restaurants and the like.

The device of this invention then is particularly adapted to the above-described needs and provides a gravity feeding mechanism which automatically holds individual potatoes or similarly dimensioned objects during slicing. When each potato is sliced the device then automatically feeds the next potato to be sliced. The device of this invention uses a cylindrical feed tube which is vertically disposed over a rotating fly wheel which mounts the slicing blade. Proximal to the slicing blade the feed tube has an expanded portion of elliptical cross-section. Potatoes are inserted into the tube, and individually enter the expanded portion. As the blade rotates slicing the potato the angled wall of the feed tube holds the potato against the slicer so that individual slices of desired thickness are automatically prepared.

Accordingly, it is an object of this invention to provide a semi-automatic, continuous potato slicer which will slice individual potatoes one at a time.

It is another object to provide a potato slicing apparatus for use with a continuous fryer of controlled volume which will rapidly and efficiently slice potatoes or similar dimensioned objects.

It is yet another object of this invention to provide a semi-automatic continuous potato slicer which utilizes a rotating fly wheel mounted blade and a vertical feed tube having a potato engaging portion which will automatically maintain a potato to be sliced in a cutting relationship with said blade as the potato is sliced.

These and other objects will become readily apparent with reference to the drawings and following description wherein.

Figure 1:
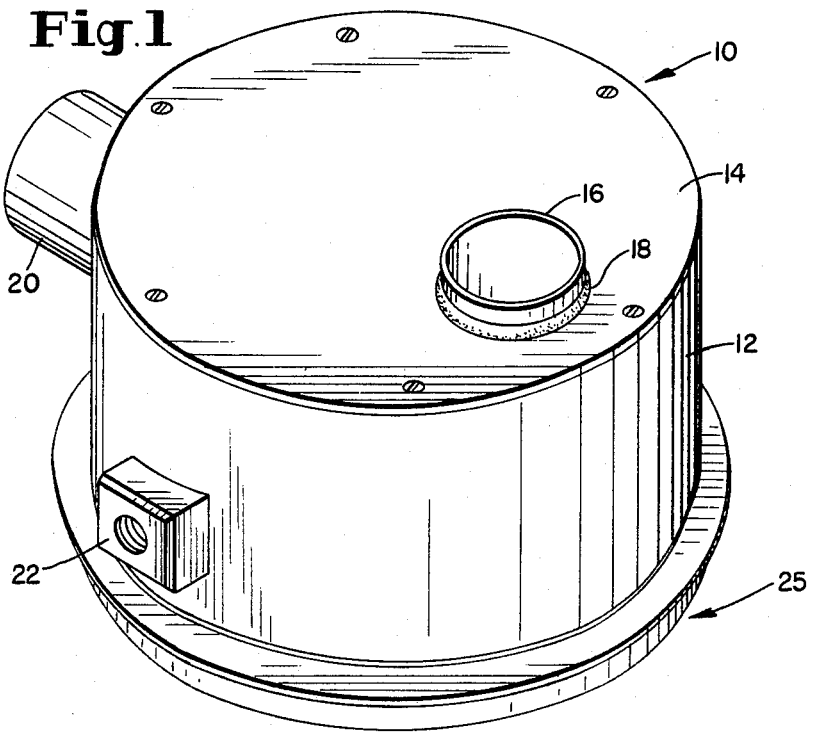
FIG. 1 is a perspective view of the device of this invention.
Figure 2:
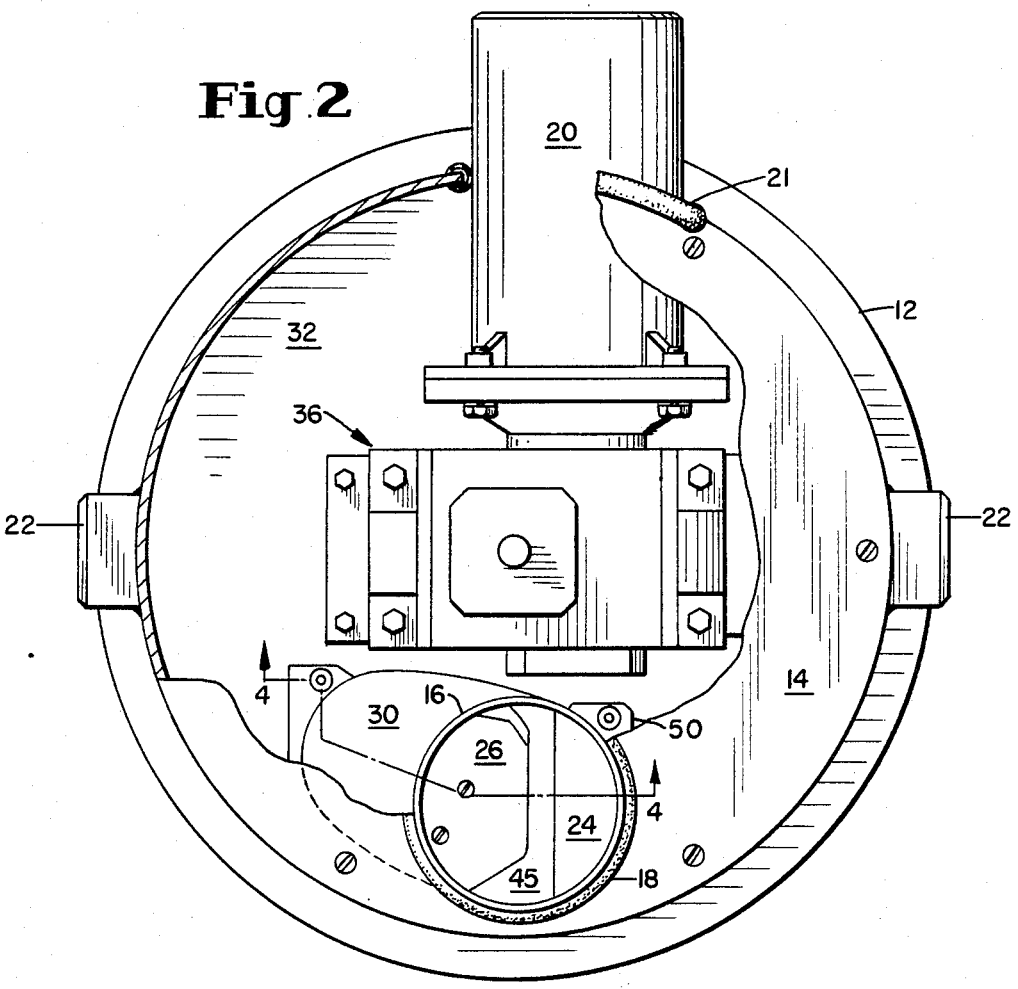
FIG. 2 is a top view of the device of FIG. 1 having a portion of the upper cover removed.
Figure 3:
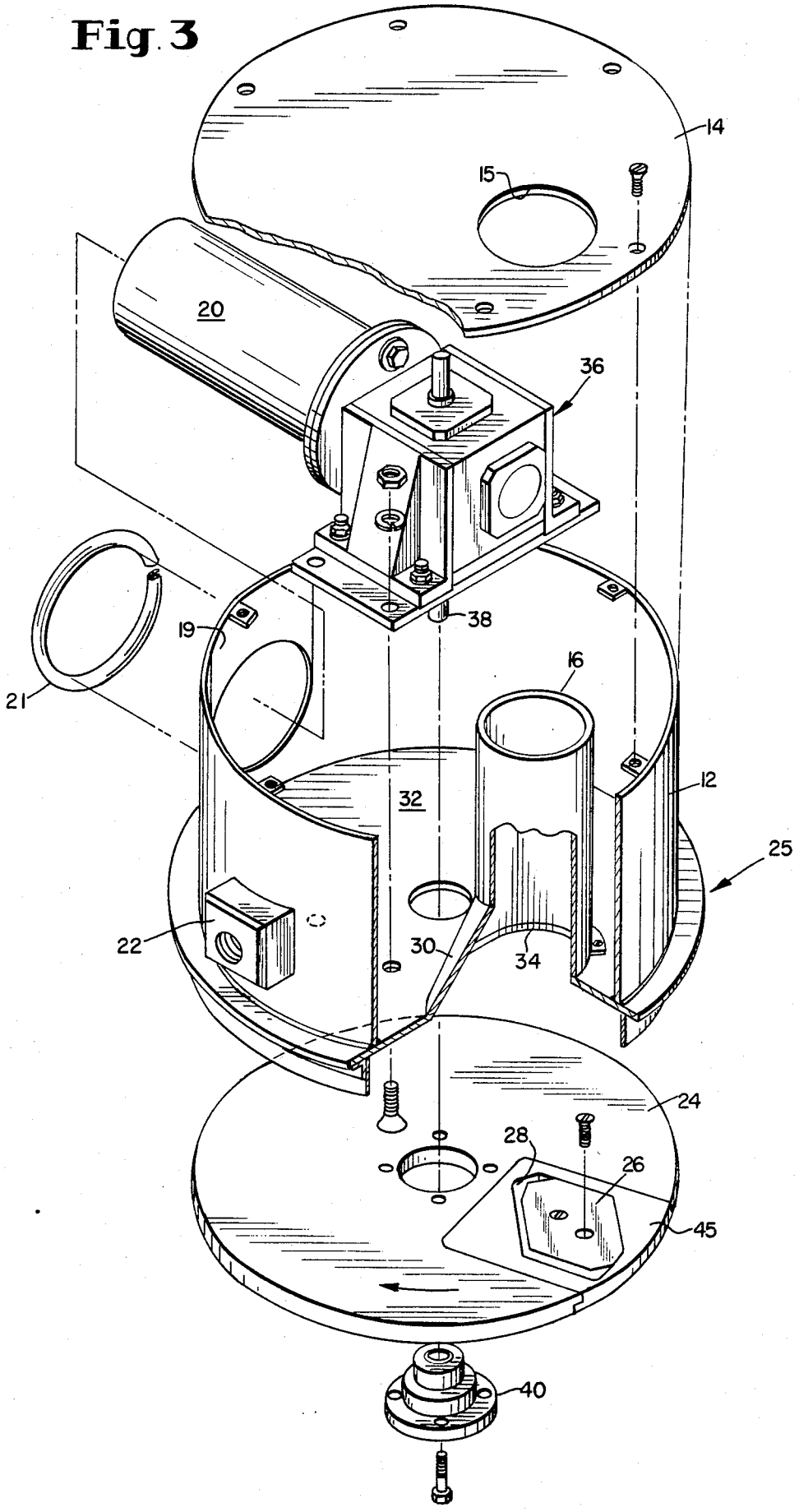
FIG. 3 is an exploded view of the device of this invention.

With attention to the drawings, the device of this invention 10 consists of a cylindrical housing 12 with a top cover 14 and an entrance port 15. A feed tube 16 extends through port 15, and preferably a gasket 18 is utilized as a seal between the feed tube 16 and the cover 14. A motor 20 is also provided together with a seal 21 which is disposed between the motor 20 and the cylindrical housing 12. A removable section 19 permits access to the motor 20. Optionally mounting brackets 22 are provided on housing 12.

The base of the device 10 consists of a fly wheel or plate 24 rotatably received within a depending skirt-like flange 25 on cylindrical housing 12. As will be subsequently explained, plate 24 is intended to rotate and mounts the cutting blade 26 in a recessed opening 28. Feed tube 16 terminates in an expanded elliptical portion 30 and is mounted on a bottom cover 32 surrounding an exit port 34 in cover 32.

The motor 20 is of conventional design, preferably a variably controlled D.C. motor using solid state D.C. control. The motor is coupled to an external source of energy (not shown). The motor drive shaft (not shown) is coupled through a gear box 36 to a vertically disposed drive shaft 38. The variable control allows for varying the production rate of potato slices. Bushing 40 is coupled to an end of shaft 38 and is mounted on fly wheel 24. Accordingly, the motor 20 drives the fly wheel 24 through shaft 38, and shaft 38 is axially located relative to cylindrical housing 12, bottom cover plate 32, and fly wheel 24. The blade 26 is eccentrically located on fly wheel 24 but radially spaced to pass under port 34 in cover 32 as the fly wheel rotates.

Figure 5:
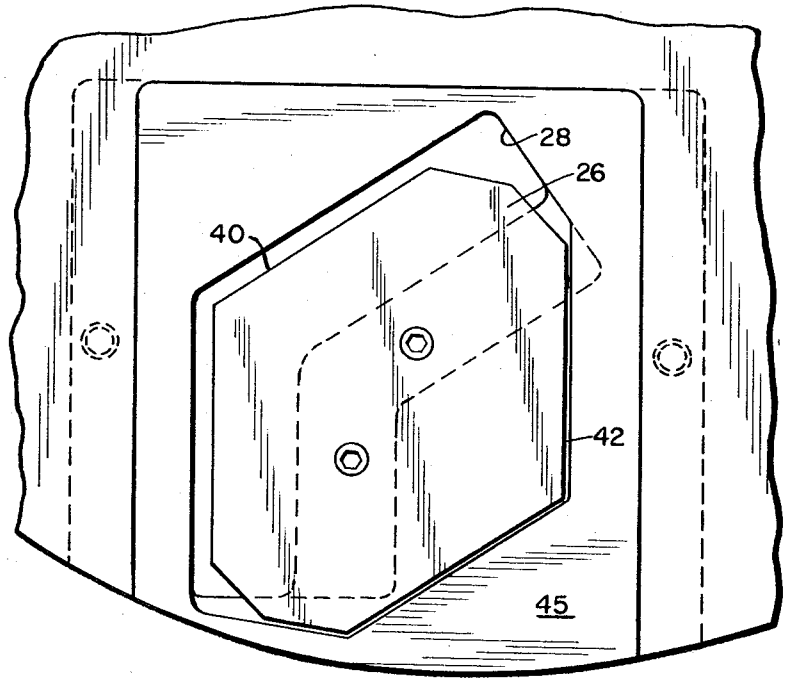
FIG. 5 is a fragmentary cross-sectional view taken along lines 5—5 of FIG. 4.
Figure 4:
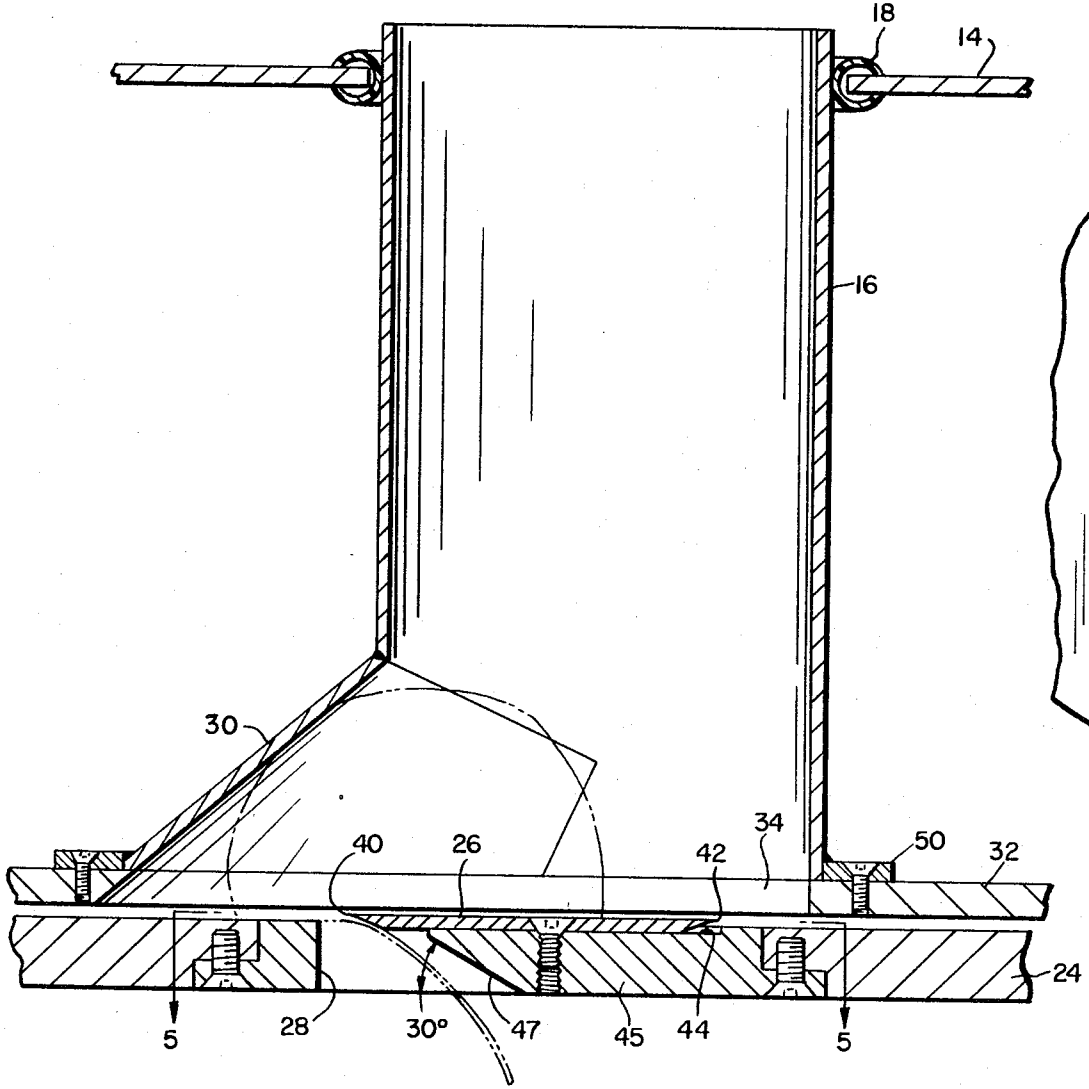
FIG. 4 is a fragmentary cross-sectional view taken along lines 4—4 of FIG. 2.

With attention to FIGS. 4 and 5, the slicing blade 28 preferably is essentially rectangular having opposed slicing edges 40 and 42. When the leading edge 40 becomes dull, the blade may be simply turned 180 degrees. When both edges 40 and 42 become dull, it will be necessary to replace the blade or sharpen it, as would be obvious to those skilled in the art.

The blade is mounted in a V-shaped recess 44 on the upper surface of fly wheel 24. A companion V-shaped port 28 is provided in fly wheel 24. The blade is held in place by removable plate 45. As shown in phantom in FIG. 4, as the potato is sliced the slice falls through V-shaped port 28 and exits the slicing machine. The leading edge of plate 45 defines a 30 degree angle rake 47 necessary for chip removal. Typically the slices would fall onto a conveyor or the like for conveying into a fryer. As fly wheel 24 rotates, a single slice is cut at each revolution Furthermore, as shown in FIG. 4, the device of this invention slices a single potato at a time. As the fly wheel rotates, the potato is urged against the elliptical expanded portion of the feed tube 30 which is angled at an acute angle to the vertical so that as the potato becomes smaller it will continue to be urged downwardly into the exit port 34 by the lateral force exerted by the blade 26 on the potato itself.

The feed tube 16 is either fed by hand or may mount a hopper (not shown). The tube is dimensioned so that the potatoes are essentially stacked one on top of the other therein. The bottom potato then would be urged into the expanded portion 30 of the feed tube so that as the blade 26 rotates it will slice the potato. When one potato has been sliced the next potato will automatically drop onto the blade 26 and fly wheel 24 and be urged into the angled portion 30 of the feed tube as it, in turn, is sliced.

The entire slicing operation then is carried out within the feed tube 16 and its lower portion 30. The interior of housing 12, which contains the axial shaft 38, gear box 36, and a portion of the motor 20, then does not come in contact with the slicing operation. The fly wheel 24 may be removed from the bottom of the device 10 by dismounting bushing 40 from shaft 38 whereby the fly wheel 24 will merely drop out. The blade 26, which is typically bolted onto fly wheel 24, then may be quickly either reversed or removed and this also facilitates cleaning the device. Access to the feed tube itself may be had through the top cover 14 which is typically bolted onto cylindrical wall 12. When the cover 14 is removed, the feed tube may also be unbolted and removed. Typically the feed tube mounts ears 50 which are bolted to bottom cover 32. Removal of the bolts then frees the feed tube so that it may be removed from the device for cleaning. The device of this invention then may be rapidly disassembled for cleaning or maintenance.

As described above, the device of this invention is intended to operate on a semi-automatic basis. The feed tube 16 typically holds several potatoes, and an operator (not shown) may be required either to feed potatoes into tube 16, or keep an external hopper (not shown) full. A conveyor (not shown) for loading tube 16 could be provided. There is no need for the operator to touch or handle the potato slices, however. In the aforementioned co-pending patent application directed to a continuous fryer, the potato chip slicer of this invention is intended to be mounted over a conveyor. As the potatoes are sliced, the slices are then conveyed into a hot oil bath for cooking, through the bath, and conveyed out of the device as cooked potato chips.

The device of this invention also is intended to provide a controlled volume of potato slices. By essentially slicing one slice per revolution of the fly wheel 24 from a single potato, the desired control volume will be provided. Therefore it will be unnecessary to pre-slice the potatoes and the potato chips will be as fresh as possible having been cooked immediately after the raw potatoes are sliced.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is intended to be claimed is:

1. A potato slicing machine for use with a continuous fryer to produce potato chips comprising:

a housing having a top cover, a bottom cover, and upstanding side walls, the top cover having an entrance port therethrough and the bottom cover having an exit port therethrough;

a circular fly wheel rotatably mounted on said housing and disposed adjacent and below the bottom cover, said fly wheel having an eccentric opening therethrough and blade means for slicing potatoes mounted in the opening, the opening being rotationally disposed in registration with the exit port in the bottom cover so that as said fly wheel rotates the opening and blade means pass under the exit port;

motor means including an axial shaft extending through the bottom cover and coupled to said fly wheel for driving said wheel, said motor means being disposed within said housing and extending through the side wall thereof; and tube means extending between the entrace port and the exit port for holding potatoes to be sliced, said tube means including wedge means adjacent the exit port for holding a potato being sliced in the exit port so that on each revolution a slice will be cut therefrom and dropped through the opening in the fly wheel, the exit port being substantially elliptical and having a long axis substantially equally radially spaced from the axis of rotation of said fly wheel, said tube and wedge means further comprising a conduit substantially circular in cross-section at the top and substantially elliptical in cross-section on the bottom connecting the entrance port and the exit port and extending through said housing, said ellipse being formed by a tapered side wall extending outwardly in the direction of rotation of said fly wheel so that as a potato is sliced the potato will be wedged against the tapered wall by the cutting action of the blade means.

2. The device of claim 1 wherein said housing is cylindrical and said fly wheel is coaxially mounted thereon with the entrance and exit ports being radially spaced outwardly therefrom.

3. The device of claim 2 wherein the opening through said fly wheel is substantially V-shaped.

* * * * *